United States Patent [19]

Gess

[11] 4,030,662

[45] June 21, 1977

[54] PACKAGE AND METHOD AND APPARATUS FOR PRODUCING SAME

[76] Inventor: Larry C. Gess, 13345 Dunlap Road, La Salle, Mich. 48145

[22] Filed: May 14, 1975

[21] Appl. No.: 577,354

[52] U.S. Cl. ..... 229/87 R; 206/461; 229/62; 426/130

[51] Int. Cl.[2] ..... B65D 65/12; B65D 65/14; B65D 75/36

[58] Field of Search ..... 426/130; 229/40, 87 R, 229/87 F, 53, 62; 206/461, 466

[56] References Cited

UNITED STATES PATENTS

| | | | |
|---|---|---|---|
| 2,304,591 | 12/1942 | Pape et al. | 426/130 |
| 2,553,923 | 5/1951 | Lambert | 229/87 P |
| 2,834,686 | 5/1958 | Reuman | 426/130 |
| 3,112,860 | 12/1963 | Ehrlund | 229/87 R |
| 3,127,274 | 3/1964 | Weinke | 229/87 F |
| 3,203,618 | 8/1965 | Andrews et al. | 229/40 |
| 3,234,705 | 7/1976 | Schwartz | 53/28 |
| 3,246,831 | 4/1966 | Teicher | 229/53 |
| 3,574,030 | 4/1971 | Callander et al. | 229/87 R |
| 3,851,068 | 11/1974 | Kraft | 426/130 |
| 3,851,814 | 12/1974 | Stage | 229/62 |

FOREIGN PATENTS OR APPLICATIONS

| | | | |
|---|---|---|---|
| 312,762 | 7/1969 | Sweden | 229/87 P |

*Primary Examiner*—William Price
*Assistant Examiner*—Bruce H. Bernstein
*Attorney, Agent, or Firm*—Allen D. Gutchess, Jr.

[57] ABSTRACT

A package and a method and apparatus for producing same are set forth. The package preferably is made of two single-faced corrugated sheets having cohesive corrugated surfaces. A lower sheet has side walls bent upwardly at edge portions thereof and flanges bent outwardly from the upper edges of the walls. An upper sheet bridges an object to be packaged located on the main portion of the lower sheet between the side walls, and has edge portions adhered to the flanges of the lower sheet. The ends of the two sheets are pressed to cause them to adhere together with the side walls simultaneously being folded outwardly at the centers and adhered to themselves. In the machine and method for producing the package, a first web has side walls bent upwardly and flanges outwardly by suitable folding rails as the web is moved longitudinally in a horizontal direction. After the object is added, a second web is brought downwardly near the first web with the side edges of the second web and the flanges of the lower web pressed together. The trailing end of one package and the leading end of another package are then pressed together and severed along a central line to complete the operation.

9 Claims, 21 Drawing Figures

FIG. 1
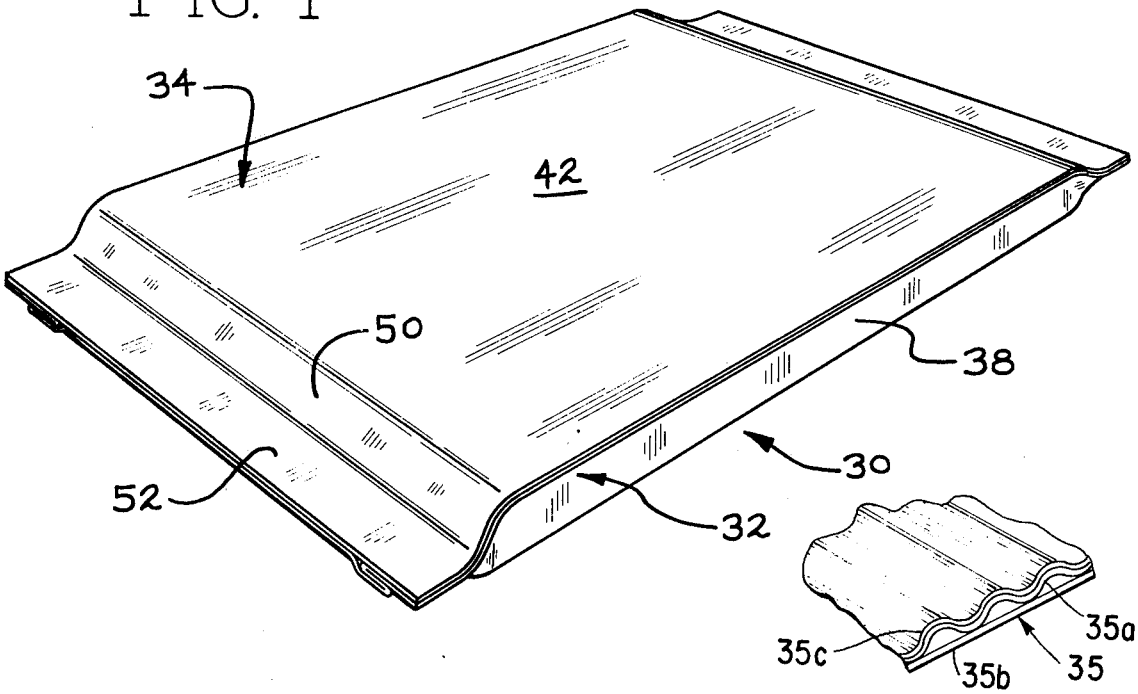
FIG. 2A
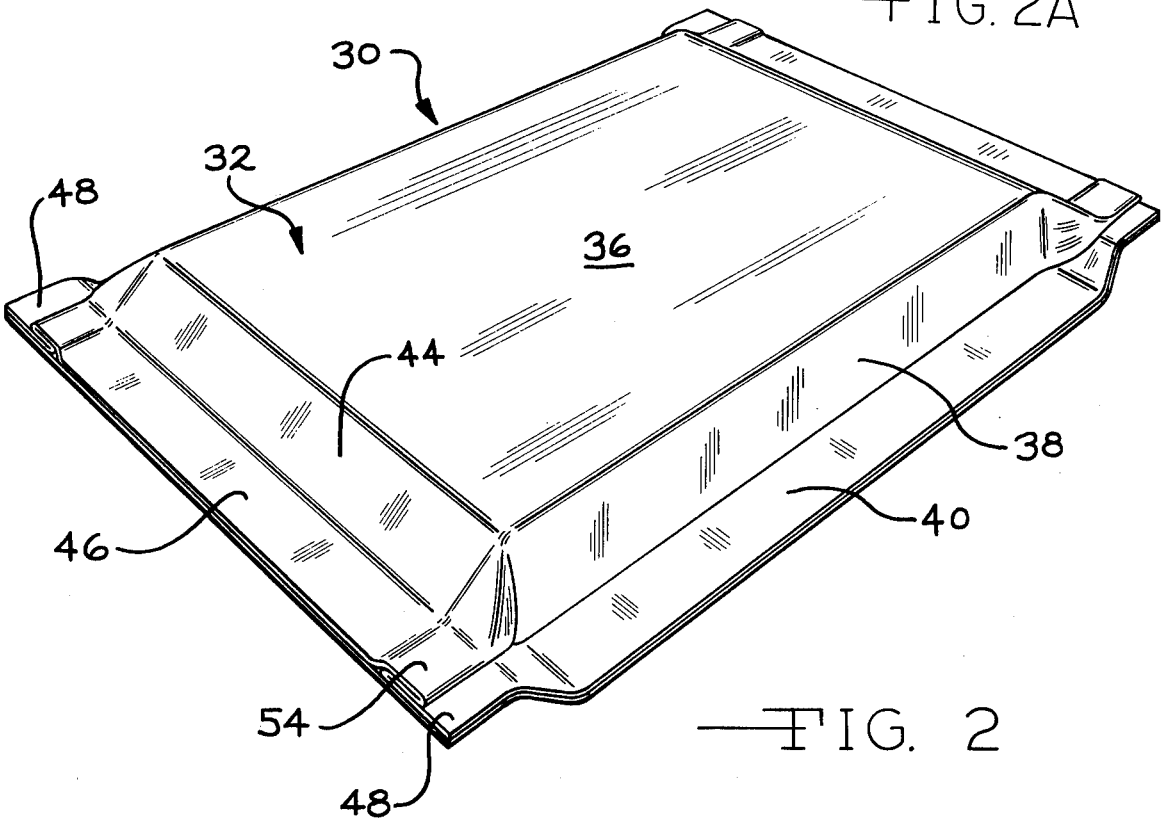
FIG. 2

FIG. 15
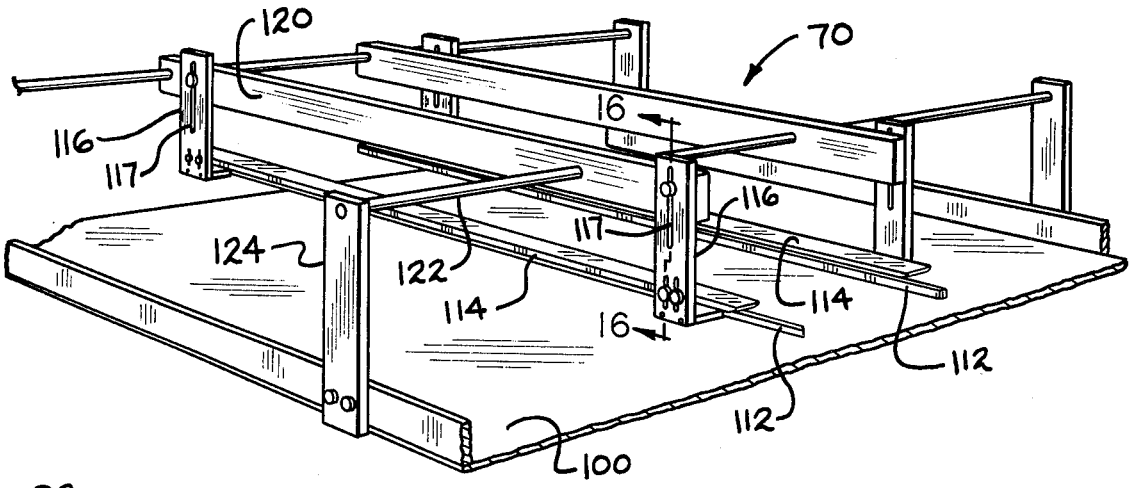
FIG. 14
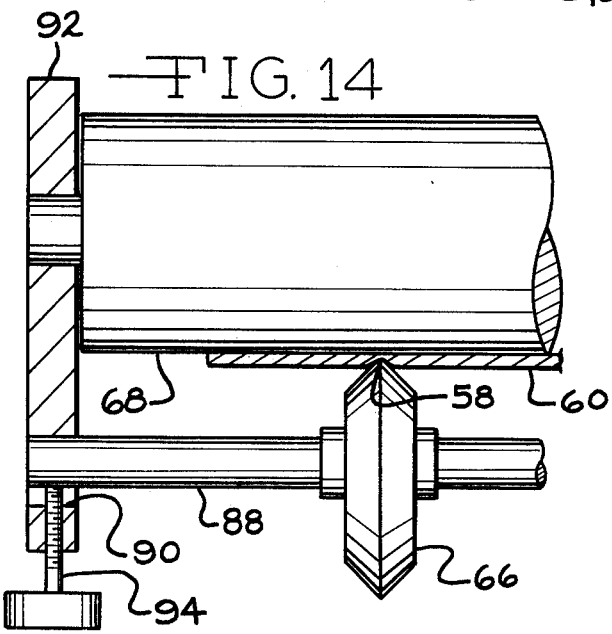
FIG. 13
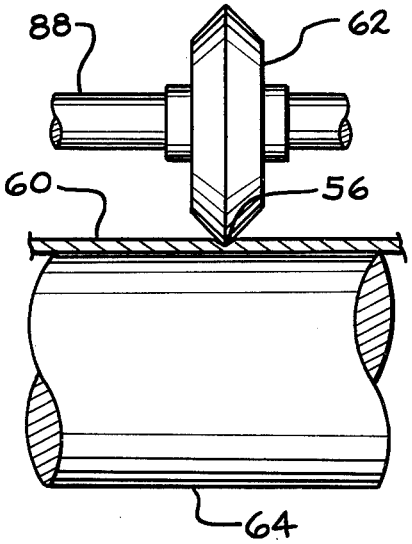
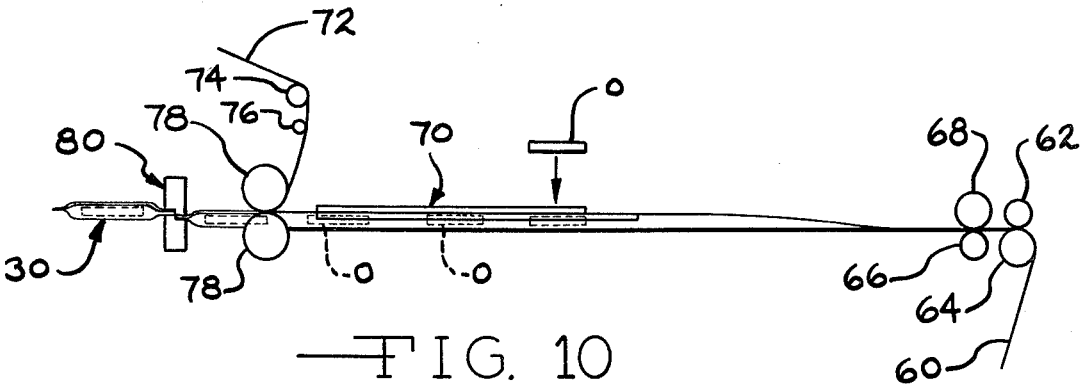
FIG. 10

FIG. 19
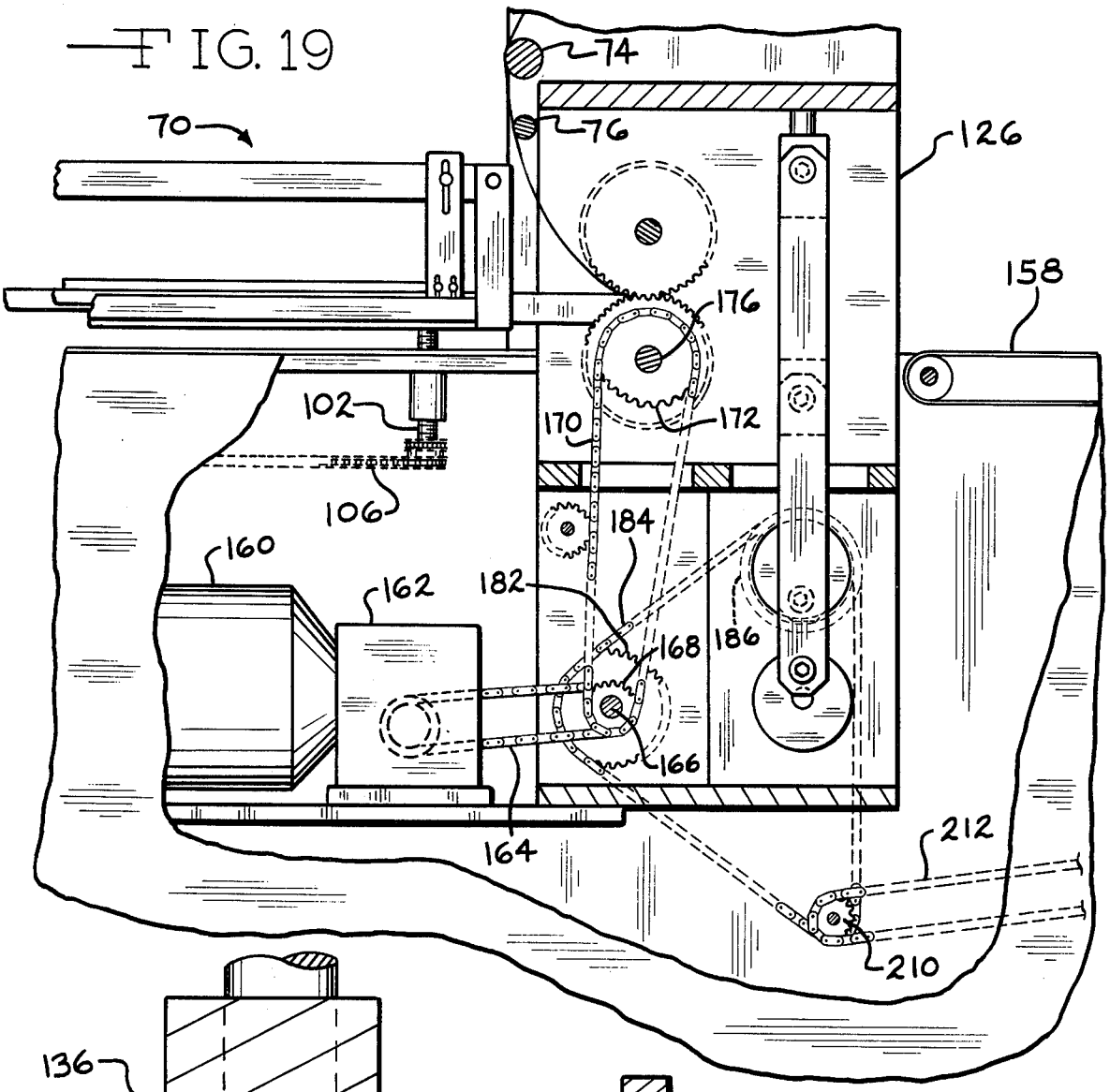
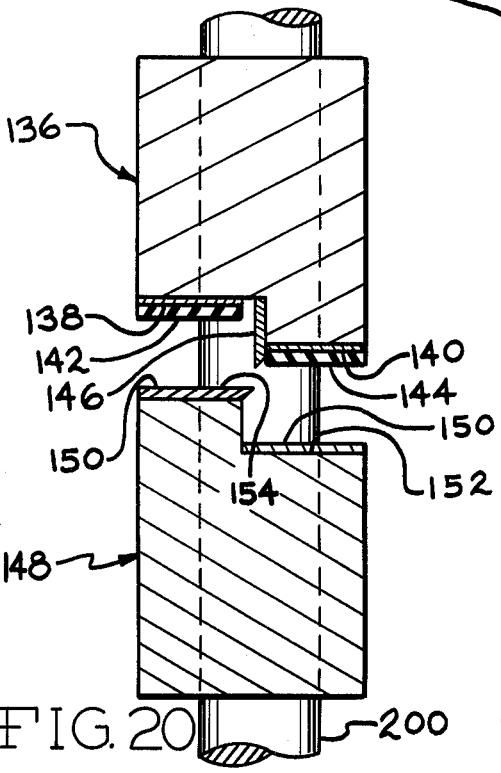
FIG. 20
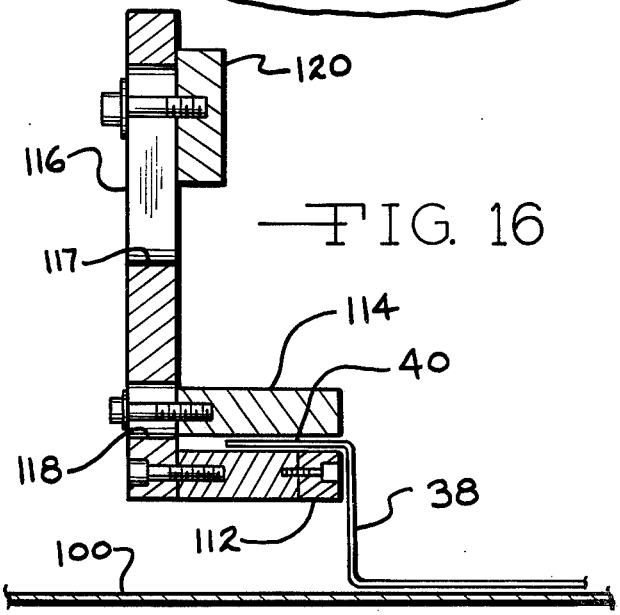
FIG. 16

PACKAGE AND METHOD AND APPARATUS FOR PRODUCING SAME

This invention relates to a package and to a method and apparatus for producing same.

From a broad standpoint, a package according to the invention includes two sheets of material between which is located an object, with the two sheets affixed together at the sides and at the ends of the packaged object. Packages of this nature are known in the art, but constitute two flat sheets having little shape and giving the appearance of being nothing more than a thick envelope. On the other hand, packages presenting a neater, square or box-like appearance are considerably more expensive to produce, requiring more expensive materials and considerably more time in effecting the packaging operation. The new package provides the speed of packaging heretofore obtained with two flat sheets of packaging material having the object between them, and yet achieves a neat, box-like appearance of a conventional box or container.

In accordance with the invention, two webs or single-faced corrugated material are positioned with the corrugated faces, which are coated with cohesive material, facing one another. The lower web is then formed with side walls bent upwardly near edge portions thereof and with upper edges of the side walls bent outwardly to form horizontally-extending flanges. The object to be packaged is then placed on the central portion of this web between the side walls, and the upper web brought down in a manner to bridge the object and to have outer portions thereof adjacent the flanges. The edges of the upper web and the flanges of the lower web are then pressed together to complete the side sealing operation. The trailing end of one package and the leading end of another package are then pressed together and severed along a central, transverse line. When the ends are pressed together, the ends of the side walls of the lower web are bent outwardly along the center thereof with the side wall portions above and below the center then adhered to one another. At the same time, the ends of the two webs beyond the packaged object are adhered to one another across the complete width thereof, with the bent, doubled side walls lying adjacent the ends of the webs. The entire package is thereby completed in little, if any, more than that required to package an object between two flat sheets of material.

It is therefore, a principal object of the invention to provide an improved package formed of two sheets of material which presents a neat, box-like appearance.

Another object of the invention is to provide a package of the type described with minimum time and cost.

A further object of the invention is to provide a method and apparatus for rapidly producing packages of the type described.

Many other objects and advantages of the invention will be apparent from the following detailed description of preferred embodiments thereof, reference being made to the accompanying drawings, in which:

FIG. 1 is a view in perspective of a package in accordance with the invention;

FIG. 2 is a view in perspective of the package of FIG. 1 when turned over;

FIG. 10 is a schematic side view in elevation of apparatus for effecting the operations on the package as depicted in FIGS. 3–9;

FIG. 13 is a detail view taken along the line 13—13 of FIG. 12;

FIG. 14 is a detail view taken along the line 14—14 of FIG. 12;

FIG. 15 is a view in perspective of a portion of the apparatus of FIGS. 11 and 12 for bending or folding a lower web of sheet material for the package;

FIG. 16 is a detail view in vertical section taken along the line 16—16 of FIG. 15;

FIG. 19 is a view in section, with parts broken away, taken along the line 19—19 of FIG. 18; and FIG. 20 is a view in transverse cross section taken along the line 20—20 of FIG. 18, but with the components closer together.

Figure 3:
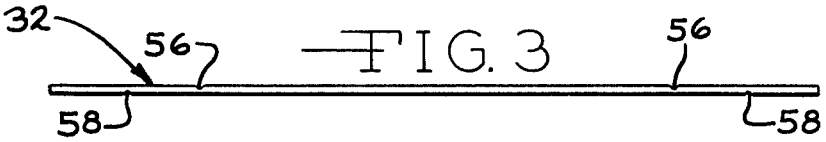
FIGS. 3–9 are somewhat schematic end views of the package in various stages of fabrication.

Referring to FIGS. 1 and 2, a package according to the invention is indicated at 30 and is made up of a lower sheet 32 and an upper sheet 34. Each of the sheets is preferably made of single-faced corrugated material 35 (FIG. 2A) with the corrugated layer **35*a* facing one another and with the smooth layers 35*b* facing outwardly. The corrugated surfaces can be treated with a cohesive coating 35*c* which causes the corrugated faces to adhere to one another but not to other materials. Such single-faced corrugated material is commercially available. Rather than the cohesive coatings, the sheets 32 and 34** can be affixed to one another by adhesive or even by mechanical fasteners such as staples. Also, of course, other sheet material can be employed in place of the single-faced corrugated materials.

The lower sheet 32 includes a central flat portion 36 with side walls 38 extending substantially perpendicularly thereto with outwardly-extending flanges 40 at the outer edges of the side walls 38 and extending substantially horizontally outwardly therefrom and perpendicularly thereto. The upper sheet 34 has a flat portion 42 which bridges over an object in the package, located on the flat portion 36 between the side walls 38, and has side edge portions affixed to the flanges 40 to transversely peripherally enclose the object.

The end of the sheets beyond the object are pressed together over the entire width. This forms angular portions 44 and central end tabs 46 on the lower sheet 32, along with outer tabs 48. Angular portions 50 and end tabs 52 are similarly formed on the upper sheet 34 with each of the end tabs 52 adhered to one of the central tabs 46 and the adjacent outer tabs 48 for the sheet 32. The ends of the side walls 38 are bent outwardly around central lines to form halves 54 which are adhered to one another and lie adjacent to the outer end tabs 48. The length of each of the central end tabs 46 is equal to the width of the central flat portion 36 while each of the outer end tabs 48 is of a length equal to the width of the flanges 40. The length of the end tab 52 equals the width of the flat portion 42 as well as the width of the sheet 32 less the height of the side walls 38.

For a deeper package, the upper sheet 34 can be formed in the same manner as the lower sheet 32 so as to double the height of the side walls 38.

The fabrication of the package 30 is depicted in FIGS. 3–9. Referring to FIG. 3, the lower sheet 32 has two upper, inner score lines 56 formed therealong at the location where the central portion 36 meets the side walls 38. Two lower, outer score lines 58 are also formed along the sheet 32, being parallel to the score lines 56 and located at the place where the side walls 38 meet the outwardly-extending flanges 40.

Figure 4:
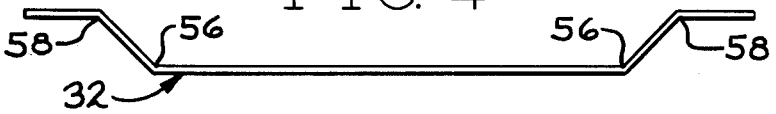
Figure 5:
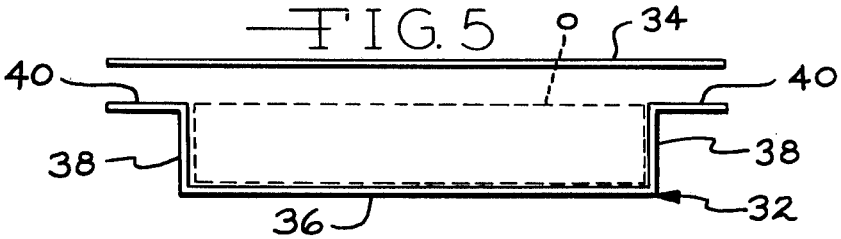

The sheet 32 is bent along the score lines 56 and 58 in the manner shown in FIG. 4 until the resulting side walls 38 and the flanges 40 are formed, as shown in FIG. 5. An ojbect o is then placed on the central portion 36 of the package with the object o in this instance substantially extending from one of the side walls 38 to the other. The upper sheet 34 is then brought to a position adjacent the lower sheet 32 with the upper sheet bridging over the object O and positioned adjacent the flanges 40.

Figure 6:
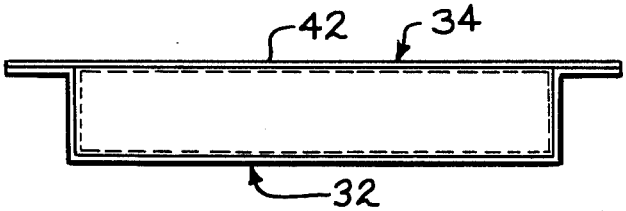

As shown in FIG. 6, the outer edges of the flat portion 42 of the sheet 34 are then pressed against the flanges 40 to cause the facing cohesive surfaces to adhere to one another. At this point, the entire object O is encompassed peripherally in a transverse direction by the sheets 32 and 34.

Figure 7:
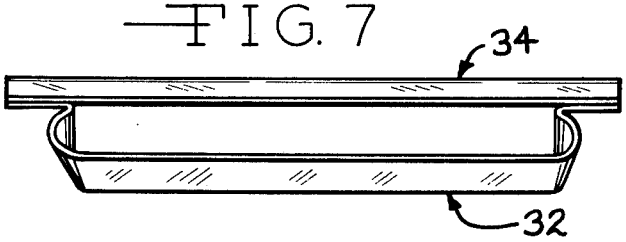
Figure 8:
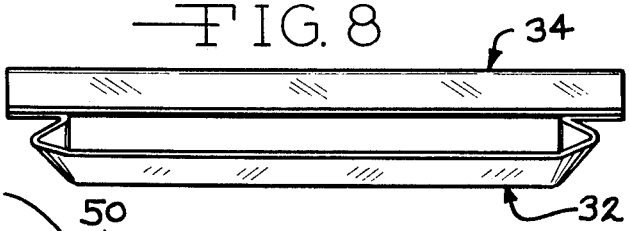
Figure 9:
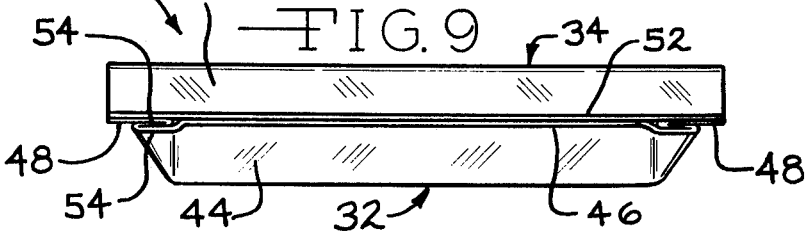
Figure 12:
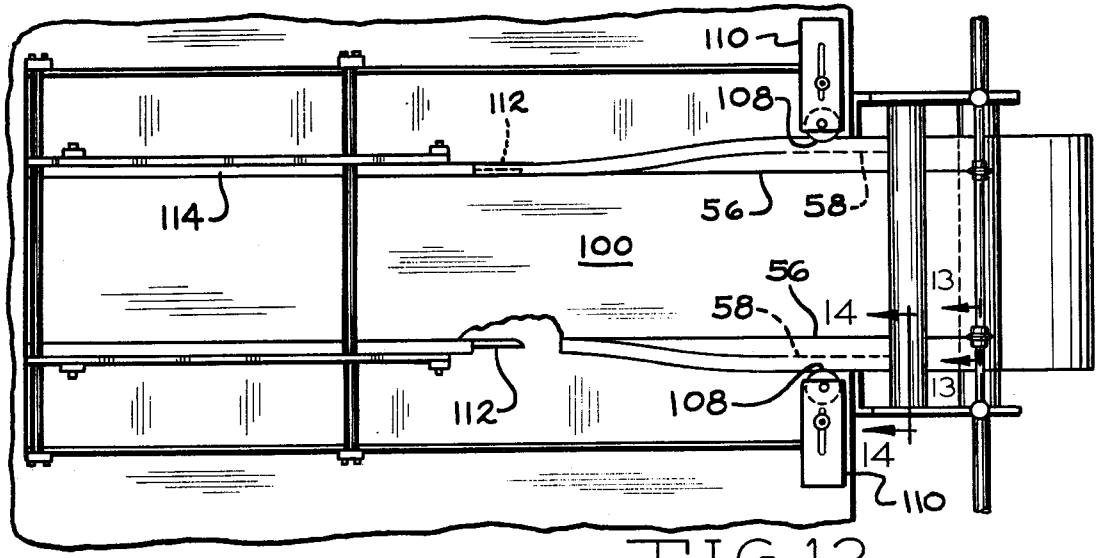
FIG. 12 is a fragmentary top view of a portion of the apparatus of FIG. 11.

Referring to FIGS. 7–9, the ends of the sheets 32 and 34 extending beyond the ends of the object O are then pressed together to complete the package. As the pressing progresses, and the ends of the sheets are brought together, the side walls begin to bulge outwardly, as shown in FIG. 7, with the bulges becoming creases or folds, as shown in FIG. 8. The outward movement of the side walls is aided by the fact that the two sheets are of single-faced corrugated material which provides greater resistance to inward movement than to outward movement. With the pressing completed, as shown in FIG. 9, the end tabs 46 and 48 are adhered to the upper end tab 52 and the resulting two halves 54 of the side walls are adhered to one another and lie contiguous to the tabs 48. This completes the package 30.

Apparatus for producing the package 30 is schematically shown in FIG. 10. Accordingly, a lower web 60 of single-faced corrugated material from which the sheets 32 are formed is fed between a first pair of upper scoring rolls 62 and a back-up roll 64 which form the upper, inner score lines 56 on the web 60. The web then passes between a pair of lower scoring rolls 66 and an upper back-up roll 68 which form the lower, outer score lines 58 on the web 60. The web 60 is then directed through a folding rail assembly 70 which forms the side walls 38 and the flanges 40 on the web 60. The object O is then placed on the flat central portion 36 of the web. An upper web 72 is brought around guide rolls 74 and 76 to a position adjacent the web 60, with the web 72 bridging the object O and being adjacent the newly-formed flanges 40 on the web 60. The outer edges of the web 72 and the flanges of the web 60 are then directed between two pair of pressure or squeeze rolls 78 which press together the outer edges of the web 72 and the flanges of the web 60 to complete the peripheral enclosure of the object O. The objects and webs are then fed through a pressing and shear assembly indicated at 80. This squeezes together the transverse portions of the webs 60 and 72 between the objects O and centrally severs them to complete the packages 30.

Figure 11:
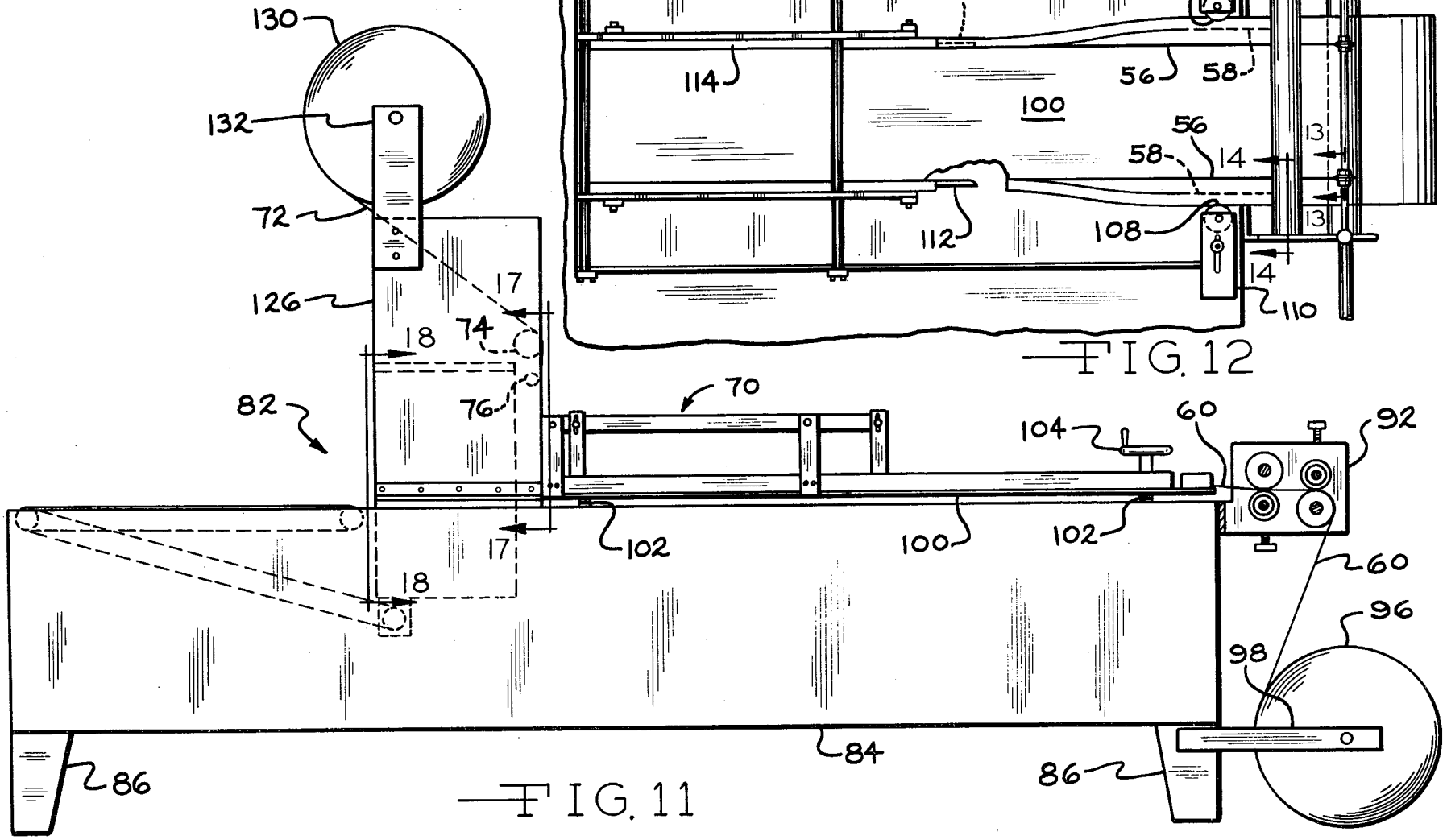
FIG. 11 is a side view in elevation of actual apparatus for producing the package.
Figure 17:
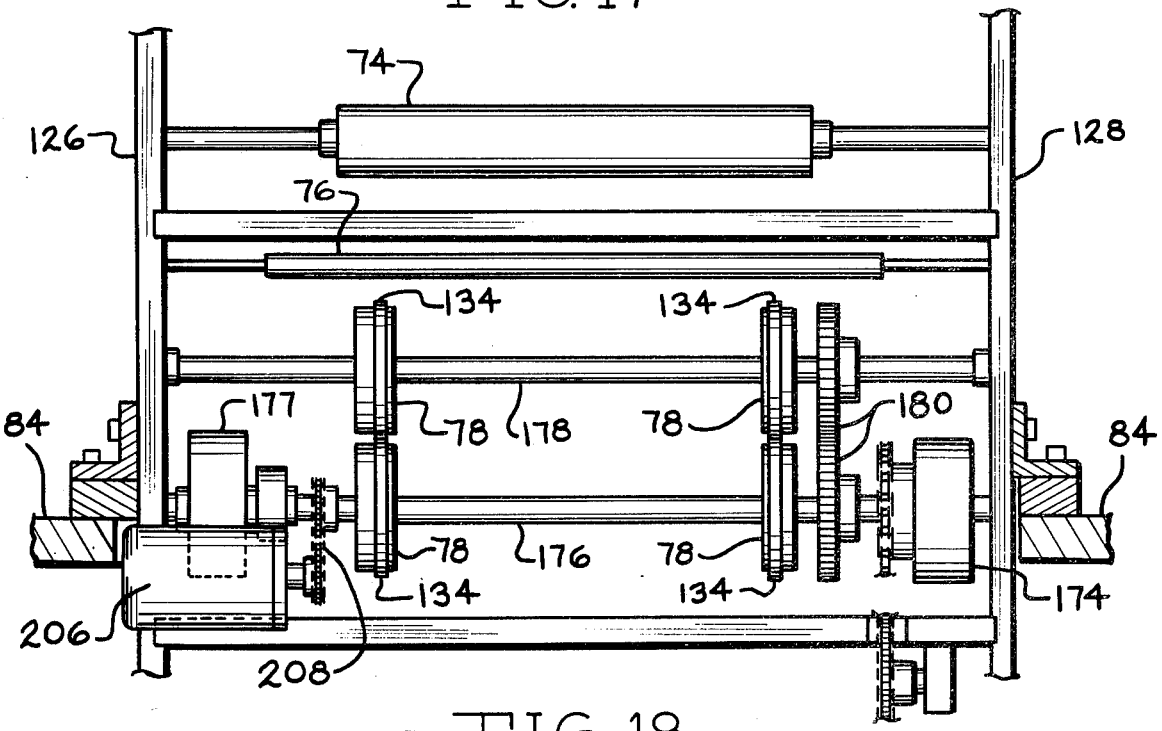
FIG. 17 is a view in vertical section taken along the line 17—17 of FIG. 11.
Figure 18:
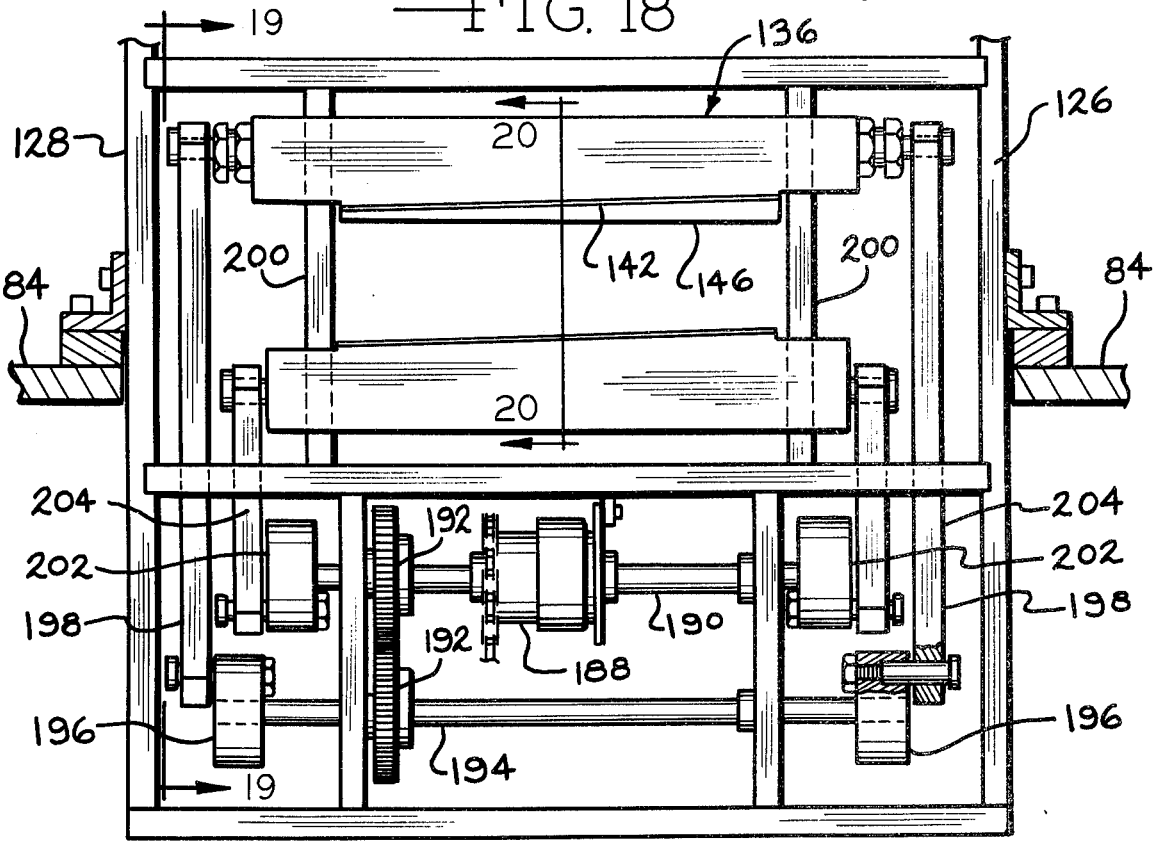
FIG. 18 is a view in vertical section taken along the line 18—18 of FIG. 11.

Actual apparatus for producing the package 30 is shown in FIGS. 11–20. Referring to FIG. 11, a machine 82 embodying the invention includes a main frame or bed 84 mounted on suitable legs 86. Referring also to FIGS. 13 and 14, the scoring rolls 62 and 66 are mounted on axles 88 which are received in slots 90 in side plates 92 which extend from the main frame 84. The axles and the rolls are vertically adjustable toward and away from their back-up rolls by adjusting screws 94. The rolls 62 and 66 can also be moved along the shafts 88, being provided with setscrews (not shown) for this purpose, to change the transverse positions of the score lines 56 and 58 on the web 60. The web 60 is supplied from a reel 96 mounted on arms 98.

After passing through the scoring rolls, the web 60 is pulled along a platform 100 located above the main frame 84 and vertically adjustable or movable by jackscrews 102 located at the four corners of the platform 100 and turned in unison by a hand wheel 104, the jackscrews being connected together by a chain 106 (FIG. 19). The vertical adjustment of the platform 100 enables the height of the side walls 38 to be changed, as will be discussed more fully subsequently.

Beyond the scoring rolls 62 and 66, the web passes between a pair of adjustable guide rolls 108 (FIG. 12) mounted on brackets 110 on the platform, the guide rolls being transversely adjustable to accommodate webs of different widths. The web 60 is then pulled through the folding rail assembly 70 with the portions of the web between the adjacent score lines 56 and 58 being bent upwardly around the score lines 56 so as to pass on the inside of said wall folding bars 112 (FIGS. 15 and 16). The outer portions of the web 60 outside of the score lines 58 pass above the bars 112 and below flange-forming strips or bars 114 to bend the web outwardly from the score lines 58 to form the flanges 40, as shown in more detail in FIG. 16. The bars 112 and the strips 114 are mounted on upright posts 116 having slots 117 for vertical adjustment relative to the platform 100, with the strips 114 being vertically adjustable relative to the bars 112 by means of slots 118 to accommodate webs of different thicknesses. The upright posts 116 are supported by bars 120 extending longitudinally of the machine, with the bars, in turn, supported by transverse rods 122. The rods 122 are held by side posts 124 which are affixed to the edges of the platform 100 so that vertical movement of the platform 100 changes the vertical position of the folding bars 112 and the strips 114. The supporting bars 120 are transversely movable of the machine along the supporting rods 122 so that the width of the package can be changed.

In order to increase the height of the side walls 38, the platform 100 is lowered by the jackscrews 102. The folding bars 112 and the strips 114 are then readjusted to position the horizontal flanges 40 of the package in alignment with the pressure rolls 78 so that they will properly feed through the rolls.

The object O to be packaged is deposited on the upper, corrugated surface of the central portion 36 between the supporting rods 122. This can be accomplished manually by an operator or by automatic feeding apparatus which can be coordinated with the movement of the web 60. After the object is deposited, the upper web 72 is pulled down near the web 60, with outer edges of the web 72 being adjacent the flanges 40 and with the central portion bridging the object O. The web 72 is fed around the two guide rolls 74 and 76

(FIGS. 11, 17, and 19) which are supported between upright side plates 126 and 128, from a reel 130 rotatably supported on arms 132. The flanges 40 of the lower web 60 and the outer edge portions of the upper web 72 are then pulled between the two pair of the pressure rolls 78 which have rubber peripheral rings 134. Pressure from the rolls 78 causes the facing corrugated surfaces of the webs 60 and 72 to be compressed somewhat and to adhere to one another by virtue of the cohesive coatings thereon. Again, glue could be applied to one or both surfaces, if desired, in place of the cohesive coatings, or even mechanical fasteners such as staples could be used.

After being compressed between the squeeze rolls 78, which are the driving force for the webs 60 and 72 being pulled from the reels 96 and 130, the package is in the form shown in FIG. 6. It then moves through the pressing and shearing assembly 82 which is shown particularly in FIGS. 18 and 20. The assembly includes a heavy upper block 136 presenting two offset pressure surfaces 138 and 140, preferably carrying resilient pressure strips 142 and 144. Between the two pressure strips is a shear blade 146. A heavy lower block 148 similarly has two stepped pressure surfaces 150 and 152 having metal strips 154 and 156 thereon, the strip 154 also constituting a shear blade. When the blocks 136 and 148 are moved together, they shear the end portions of the webs 60 and 72 between the objects O and, at the same time, apply pressure to the entire transverse width of the webs to form the ends of the package. The trailing edge of one of the packages 30 is squeezed between the metal strip 154 and the resilient strip 142 while the forward edge of the next package is squeezed between the metal strip 156 and the resilient strip 144. As the blocks 136 and 138 move toward one another, the ends of the package assume the configurations progressively shown from FIGS. 7 to 9 so that when the blocks 136 and 148 move apart again, one of the packages 30 is completed. At this time, the webs 60 and 72 are sheared to leave the lower and upper sheets 32 and 34. The finished package is then carried away on a discharge belt conveyor 158.

All of the components of the machine 82 are driven by a single motor 160 (FIG. 19) which connects through a reducer 162 to a main drive chain 164. This drives a main shaft 166 which drives a sprocket 168 and a chain 170 for the pressure rolls 78. The rolls are driven through a sprocket 172 and an electromagnetic clutch 174 (FIG. 17) located on a lower shaft 176 for the lower pressure rolls 78, this shaft also having an electromagnetic brake 177. An upper shaft 178 is driven through a pair of spur gears 180 to drive the upper pressure rolls at equal speeds, but in opposite directions, to the lower pressure rolls.

A larger sprocket 182 on the shaft 166 drives a chain 184 which drives a sprocket 186 associated with an electromagnetic clutch 188 (FIG. 18) on a shaft 190, the clutch 188 also being a one-revolution type which rotates through only one revolution when energized. The shaft 190, through a pair of spur gears 192, drives a lower shaft 194. The upper block 136 is driven off the shaft 194 by end eccentrics 196 and links 198, the blocks being mounted on guide posts 200 (also FIG. 20). The lower block 148 is driven in the opposite directions by eccentrics 202 and links 204. When the clutch 188 is energized for one revolution, the blocks 136 and 148 move from the position of FIG. 18 to a shearing position in which the shear blades 146 and 154 of FIG. 20 overlap and then back to the open position again.

The pressure rolls 78 are driven for as long as the electromagnetic clutch 174 is energized with this time determining the length of the final package 30. To control the package lengths, a commercially-available counter 206 (FIG. 17) is driven at a speed synchronous with the speed of the machine through a chain 208. The counter 206, which is commercially available from L. C. Gess, Inc. of Toledo, Ohio, actually includes a disc having a multiplicity of equally spaced, radially-extending marks thereon which are counted by a counter. When a predetermined count has been reached, the counter deenergizes the clutch 174 and energizes the brake 177 to immediately stop the pressure rolls 78. At the same time, the counter causes the one-revolution electromagnetic clutch 188 to be energized to cut and form the package ends. At the end of the one revolution, the electromagnetic clutch 174 is energized again to again advance the webs 60 and 72. The finished package is carried off on the discharge conveyor 158 which has a tail pulley driven by the chain 184 along with a sprocket 210 and a chain 212 (FIG. 19).

various modifications of the above-described embodiments will be apparent to those skilled in the art and it is to be understood that such modifications can be made without departing from the scope of the invention if they are within the spirit and the tenor of the accompanying claims.

I claim:

1. A package for containing an object, said package comprising a first sheet of material having an object-receiving central portion with two straight opposite side edges and two end edges, said sheet having two upstanding side walls along the opposite side edges thereof, and two outwardly-extending flanges at the outer edges of the side walls, only end portions of said side walls being bent outwardly on themselves along lines which extend longitudinally of the side walls and are centrally located between longitudinal edges of the side walls with intermediate portions of said side wall between said end portions being straight and with inner surfaces of said end portions which would otherwise face the object being in contiguous relationship, and a second sheet of material, the width of which is less than that of said first sheet by substantially the heighth of both of the side walls, said second sheet having side edge portions affixed to said outwardly-extending flanges and having end portions affixed to end portions of said first sheet to form a closed spaced between the central portion of said first sheet and said second sheet, said second sheet being substantially straight as viewed in transverse cross section anywhere along the length of said second sheet.

2. A package according to claim 1 characterized by said end portions of said second sheet being affixed only to end portions of said two oppositely-extending flanges and to end portions of said central portion of said first sheet.

3. A package according to claim 1 characterized by the bent end portions of said side walls being affixed to themselves.

4. A package according to claim 2 characterized by the bent end portions of said side walls being affixed to themselves and being located adjacent the end portions of said oppositely-extending flanges.

5. A package according to claim 1 characterized by said sheets being a single-faced corrugated material.

6. A package according to claim 5 characterized by said single-faced corrugated material having a cohesive coating on one side thereof.

7. A package according to claim 1 characterized by said material having a smooth side and a corrugated side with a cohesive coating material on the corrugated side.

8. A package for containing an object, said package comprising a first sheet of single-faced corrugated material having a cohesive surface on the corrugated side, said sheet having an object-receiving, central portion with two side walls extending perpendicular to said central portion along opposite side edges thereof and with two outwardly-extending flanges at the outer edges of said side walls, a second sheet of single-faced corrugated material having a cohesive surface on the corrugated side and facing the cohesive surface of said first sheet, said second sheet having side edge portions affixed to said outwardly-extending flanges and having end portions affixed to end portions of said central portion of said first sheet and to end portions of said flanges of said first sheet, and portions of said side walls being bent outwardly on themselves along lines which extend longitudinally of the side walls and are centrally located between longitudinal edges of said side walls with the cohesive surfaces thereof being affixed together and lying adjacent said end portions of said flanges, said second sheet being substantially straight as viewed in transverse cross section taken anywhere along the length of said second sheet.

9. A package according to claim 8 characterized by the corrugations of said first sheet extending across the package from one of said flanges to the other.

* * * * *

UNITED STATES PATENT OFFICE

CERTIFICATE OF CORRECTION

PATENT NO. : 4,030,662

DATED : June 21, 1977

INVENTOR(S) : Larry C. Gess

It is certified that error appears in the above-identified patent and that said Letters Patent are hereby corrected as shown below:

Column 1, line 46, after "more" insert --time--.

Column 2, line 30, for "layer" substitute --layers--.
line 52, for "end" substitute --ends--.

Column 3, line 15, for "ojbect" substitute --object--, and for "o" substitute --O--.

Column 6, line 24, for "various" substitute --Various--
line 41, for "wall" substitute --walls--.
line 50, for "spaced" substitute --space--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*